US010295266B2

(12) United States Patent
Singh et al.

(10) Patent No.: US 10,295,266 B2
(45) Date of Patent: May 21, 2019

(54) TUBULAR HEAT EXCHANGER HAVING MULTIPLE SHELL-SIDE AND TUBE-SIDE FLUID PASSES

(71) Applicant: Holtec International, Marlton, NJ (US)

(72) Inventors: Krishna P. Singh, Hobe Sound, FL (US); Vytautas Vincas Maciunas, Cherry Hill, NJ (US)

(73) Assignee: Holtec International

( * ) Notice: Subject to any disclaimer, the term of this patent is extended or adjusted under 35 U.S.C. 154(b) by 192 days.

(21) Appl. No.: 15/279,730

(22) Filed: Sep. 29, 2016

(65) Prior Publication Data

US 2017/0016678 A1 Jan. 19, 2017

Related U.S. Application Data

(63) Continuation-in-part of application No. 15/210,125, filed on Jul. 14, 2016, now abandoned.

(60) Provisional application No. 62/192,318, filed on Jul. 14, 2015.

(51) Int. Cl.

| | |
|---|---|
| ***F28D 7/10*** | (2006.01) |
| ***F28D 7/00*** | (2006.01) |
| ***F28F 9/22*** | (2006.01) |
| ***F28D 7/16*** | (2006.01) |
| *F28D 7/06* | (2006.01) |
| *F28F 9/26* | (2006.01) |

(52) U.S. Cl.

CPC ..... *F28D 7/1646* (2013.01); *F28D 7/1607* (2013.01); *F28D 7/06* (2013.01); *F28F 9/26* (2013.01); *F28F 2009/224* (2013.01)

(58) Field of Classification Search

CPC ..... F28F 9/26; F28F 2009/224; F28D 7/06; F28D 7/1646; F28D 7/1607

USPC ..... 165/140, 161, 160, 157

See application file for complete search history.

(56) References Cited

U.S. PATENT DOCUMENTS

| | | | | |
|---|---|---|---|---|
| 1,672,650 A | | 6/1928 | Lonsdale | |
| 1,683,236 A | | 9/1928 | Braun | |
| 1,790,828 A | | 2/1931 | McKnight | |
| 1,813,234 A | | 7/1931 | Dodd | |
| 1,848,741 A | * | 3/1932 | Nelson | F28F 9/22 165/160 |
| 1,948,550 A | | 2/1934 | Voorheis | |

(Continued)

FOREIGN PATENT DOCUMENTS

WO 2016008675 1/2016

*Primary Examiner* — Paul Alvare

(74) *Attorney, Agent, or Firm* — The Belles Group, P.C.

(57) ABSTRACT

A tubular heat exchanger having a plurality of shell-side and tube-side fluid passes. The heat exchanger includes an elongated cylindrical shell, a head coupled thereto, and a tube bundle positioned in the shell and supported in part by a tube sheet attached to the head. The shell of the heat exchanger may include a plurality of vertically stacked shell-side compartments each defining a shell-side pass. The head of the heat exchanger may have a plurality of tube-side compartments each defining a tube-side pass. A tube-side fluid enters the head and flows through the tube bundle progressively through a series of tube-side passes to heat the fluid with a shell-side fluid. Each shell-side pass contains multiple tube-side passes. The tube-side fluid may perform a plurality of horizontally arranged tube-side fluid passes in each vertically stacked shell-side fluid pass before cascading vertically to a next shell-side fluid pass.

12 Claims, 4 Drawing Sheets

(56) References Cited

U.S. PATENT DOCUMENTS

| | | | | | |
|---|---|---|---|---|---|
| 1,962,362 | A | | 6/1934 | Reed | |
| 3,958,630 | A | | 5/1976 | Smith | |
| 4,105,065 | A | | 8/1978 | Chirico | |
| 4,253,516 | A | | 3/1981 | Giardina | |
| 4,441,550 | A | * | 4/1984 | Chase | F28D 7/06 165/145 |
| 4,858,681 | A | | 8/1989 | Sulzberger | |
| 4,972,903 | A | * | 11/1990 | Kwok | F28D 7/06 165/158 |
| 5,291,944 | A | | 3/1994 | Sanz et al. | |
| 2010/0116477 | A1 | | 5/2010 | Mulder | |
| 2010/0282450 | A1 | | 11/2010 | Mulder | |
| 2014/0262162 | A1 | | 9/2014 | Zimmer et al. | |

* cited by examiner

TUBULAR HEAT EXCHANGER HAVING MULTIPLE SHELL-SIDE AND TUBE-SIDE FLUID PASSES

CROSS-REFERENCE TO RELATED APPLICATIONS

The present application is a continuation-in-part of U.S. patent application Ser. No. 15/210,125 filed Jul. 14, 2016, which claims the benefit of U.S. Provisional Patent Application Ser. No. 62/192,318, filed Jul. 14, 2015; the entireties of which are hereby incorporated by reference.

FIELD OF THE INVENTION

The present invention relates generally to a heat exchanger, and more particularly to a novel class of flow pass arrangements in tubular heat exchangers that seeks to minimize the number of heat exchangers that may be required in series or parallel used in a piping network for heat transfer applications.

BACKGROUND OF THE INVENTION

Generally, a tubular heat exchanger consists of a shell or large vessel with a bundle of tubes inside of the shell. Two fluids of different starting temperatures flow through the heat exchanger. The fluid with the higher starting temperature is known as the primary fluid and the fluid with the lower starting temperature is known as the secondary fluid. One primary fluid, known as the tube-side fluid, flows inside of the tubes while a second fluid, known as the shell-side fluid, flows outside of the tubes through the shell. The fluids may both be liquids, or they may both be gases, or one may be a gas while the other is a liquid. Furthermore, either of the primary fluid or the secondary fluid may be the tube-side fluid or the shell-side fluid. During operation of the heat exchanger, heat is transferred between the two fluids without direct contact between the two fluids. Specifically, heat is transferred from the primary fluid, through the walls of the tubes, and into the secondary fluid. The transfer of heat without contact between the shell-side fluid and the tube-side fluid is particularly desirable in the nuclear power plant industry because the primary or secondary fluids may become radioactive. Depending upon the fluids used and the desired results, heat is transferred either from the tube-side fluid to the shell-side fluid or vice versa.

The state-of-the art in flow arrangements for tubular heat exchangers generally indicates that the number of shell passes in industrial practice is restricted to two. A shell-side or tube-side pass in the art is considered to be the number of times that the fluid traverses the effective working length of the heat exchanger. If the demands of fluid flow rates and their terminal temperatures of the two heat exchanging streams cannot be satisfied in a single or two shell pass unit (or its close adaptations known as "spilt flow" and "divided flow" shown in the Tubular Exchanger Manufacturers Association or TEMA standards tables), then the designer is forced to utilize multiple heat exchanger shells each with internal tube bundles and use interconnecting pipes to fluidly coupled the shells together (see, e.g. FIG. 6). The multi-shell arrangement is poor design palliative, not in the least because it creates several external flanged joint connections that may leak during service. Multiplicity of shells also increases the plant's capital cost.

An improved heat exchanger is desired.

SUMMARY OF THE INVENTION

A tubular heat exchanger according to the present disclosure replaces a number of distinct heat exchangers arranged in series or parallel by a single shell heat exchanger with multiple internal shell and tube pass arrangements such that the shell-side fluid traverses the length of the heat exchanger shell multiple times in discrete shell-side and tube-side flow compartments. Within each shell-side pass (hereafter also referred to as the "compartment"), the tube-side fluid may be arranged to traverse the length of the shell multiple times. The tube-side may include multiple tube-side compartments to steer the tube-side fluid through the various tube-side passes. In one non-limiting embodiment, each shell pass may include a horizontally arranged U-tube tube bundle comprising an outer tube bundle array and an inner tube bundle array nested inside the outer tube bundle array to form the multiple tube-side passes within each shell-side compartment or pass. A plurality of vertically stacked horizontal tube bundles may thus be disposed within the shell cavity of the heat exchanger.

In one aspect, a heat exchanger includes: a pressure vessel comprising a shell cavity, a shell inlet configured to introduce a shell-side fluid into the shell cavity, and a shell outlet configured to allow the shell side fluid to escape the shell cavity, the pressure vessel extending along a longitudinal axis; a shell-side fluid flow control system disposed within the shell cavity and configured to flow the shell-side fluid through the shell cavity, from the shell inlet to the shell outlet, the shell-side fluid flowing through a plurality of vertically stacked shell-side fluid passes; a tube bundle disposed within the shell cavity, the tube bundle comprising a plurality of tube inlets and a plurality of tube outlets, the tube bundle configured to carry flow of a tube-side fluid from the tube inlets to the tube outlets such that the tube-side fluid performs a first set of plural horizontally arranged tube-side fluid passes in a first one of the vertically stacked shell-side fluid passes and a second set of plural horizontally arranged tube-side fluid passes in a second one of the vertically stacked shell-side fluid passes; wherein the tube-side fluid completes all horizontally arranged tube-side fluid passes in each shell-side fluid pass before cascading to a next shell-side fluid pass.

In another aspect, a tubular heat exchanger includes: a shell comprising a shell cavity, a shell inlet to introduce a shell-side fluid into the shell cavity, and a shell outlet to exhaust the shell-side fluid from the shell cavity, the pressure vessel extending along a longitudinal axis and having a length; the shell cavity comprising a plurality of longitudinal baffles dividing the shell cavity into multiple vertically stacked shell-side flow passes, wherein the shell-side fluid traverses the length of the shell cavity at least more than twice between the shell inlet and the shell outlet; a stationary head attached to the shell and comprising an internal tube-side plenum fluidly isolated from the shell cavity, a tube-side inlet to introduce a tube-side fluid into the tube-side plenum, and a tube-side outlet to discharge the tube-side fluid from the tube-side plenum; a plurality of vertically stacked horizontal rows of tube bundle sets inside the shell and in fluid communication with the tube-side plenum, each tube bundle set comprising an outer tube bundle array and an inner tube bundle array nested inside the outer tube bundle array; each shell-side flow pass including a tube bundle set which forms a plurality of tube-side flow passes in each shell-side flow pass; wherein the tube-side fluid flows in a vertically cascading pattern from an uppermost tube bundle set fluidly coupled to the tube-side inlet, through a plurality of intermediate tube bundle sets, and to a lowermost tube bundle set fluidly coupled to the tube-side outlet.

A method for operating a tubular heat exchanger includes: providing a heat exchanger including a shell defining a plurality of vertically stacked shell-side fluid passes, a tube-side plenum fluidly isolated from the shell-side and comprising a plurality of tube-side fluid passes, and a plurality of vertically stacked horizontal rows of tube bundle sets inside the shell and in fluid communication with the tube-side plenum; receiving a tube-side fluid in a first one of the tube-side fluid passes; the tube-side fluid flowing horizontal through a first set of horizontally arranged tube-side fluid passes in a first one of the tube bundle sets in a first one of the vertically stacked shell-side fluid passes; the tube-side fluid cascading vertically to an adjacent second one of the vertically stacked shell-side fluid passes; the tube-side fluid flowing horizontally through a second set of horizontally arranged tube-side fluid passes in a second one of the tube bundle sets in the second one of the vertically stacked shell-side fluid passes; the tube-side fluid cascading vertically to an adjacent third one of the vertically stacked shell-side fluid passes; and the tube-side fluid flowing horizontally through a third set of horizontally arranged tube-side fluid passes in a third one of the tube bundle sets in the third one of the vertically stacked shell-side fluid passes.

These objects and others will become apparent from the following disclosure and drawings.

Figure 1:
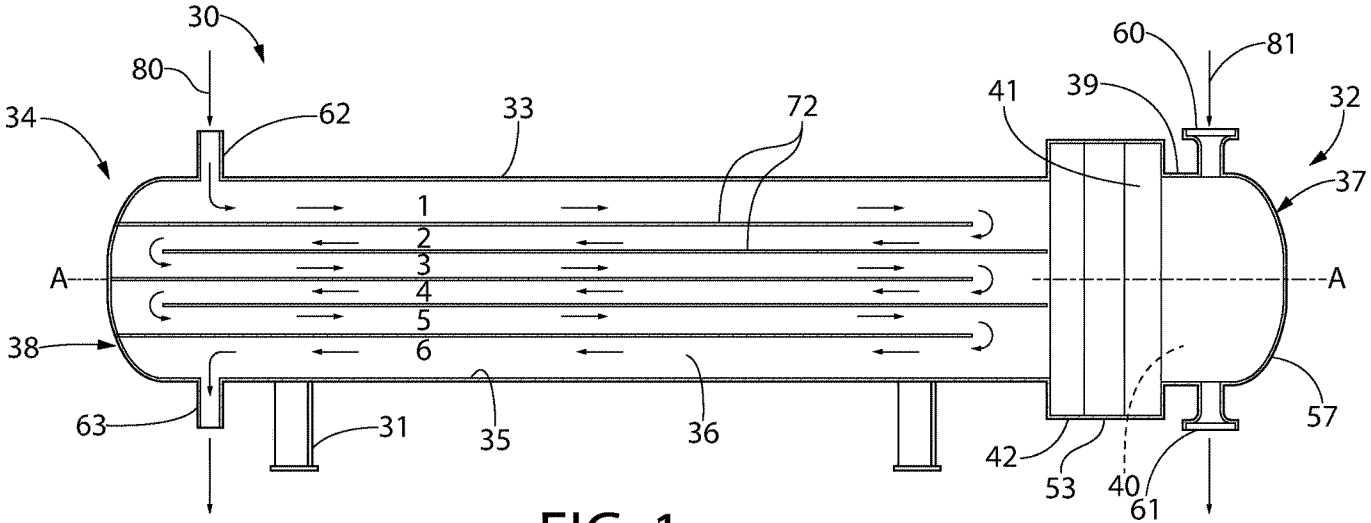
FIG. 1 is side view schematic diagram of a heat exchanger according to the present disclosure showing an arrangement of internal shell-side longitudinal baffles which define shell-side fluid passes.

All drawings are schematic and not necessarily to scale.

DETAILED DESCRIPTION OF THE INVENTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

When and as used throughout, any ranges disclosed herein are used as shorthand for describing each and every value that is within the range. Any value within the range can be selected as the terminus of the range.

Figure 2:
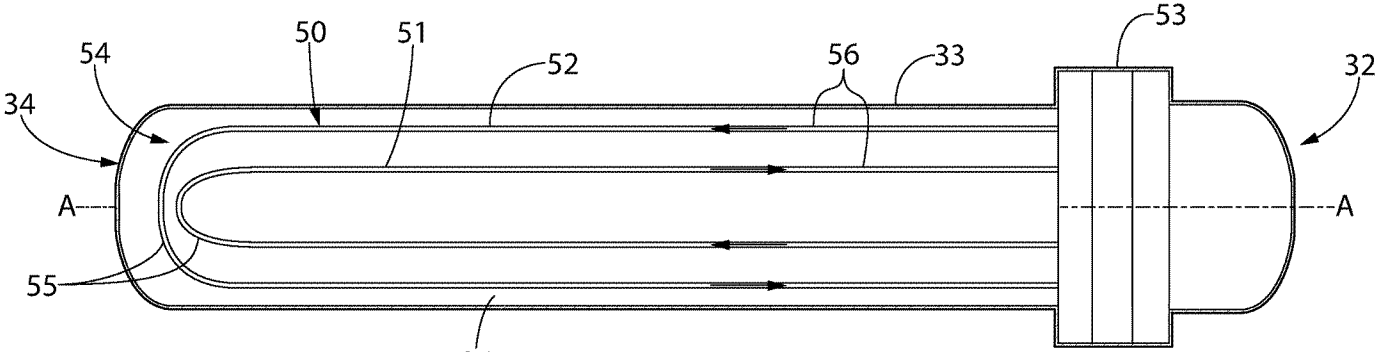
FIG. 2 is a top view schematic diagram showing one representative U-tube each of inner and outer tube bundles.

Referring to FIGS. 1 and 2, an embodiment of a tubular heat exchanger 30 according to the present disclosure is illustrated. The heat exchanger 30 is of a multiple tube-side and shell-side fluid or flow pass design intended to minimize the pressure loss of the shell-side fluid while still maintaining a stable, vibration-free environment for a tube bundle 50 positioned within the heat exchanger.

The tubular heat exchanger 30 is an elongated vessel that extends along a longitudinal axis A-A from a proximal end 32 to an opposing distal end 34. The heat exchanger 30 may include a plurality of vents and drains used for emptying a shell-side fluid from the vessel. The heat exchanger 30 may include fixed supports 31 for maintaining the heat exchanger 30 in a horizontal orientation in the illustrated embodiment. Of course, the invention is not limited to a horizontal heat exchanger and the heat exchanger may be vertically or otherwise oriented as would be known to persons skilled in the art.

Preferably, all components of the heat exchanger 30, including the shell 33, the tube bundle 50, and all other major components except for seals and the like, are constructed of various metal depending on the component's function and service conditions, such as for example without limitation steel, aluminum, titanium, nickel, Inconel®, alloys, iron or others. Of course, other metals and materials can be used for the various components as long as the proper thermal transfer can be effectuated between the shell-side fluid and the tube-side fluid.

The heat exchanger 30 generally comprises a longitudinally-extending cylindrical shell 33 having an inner surface 35 that forms an internal cavity 36 with tube bundle 50 positioned therein. A stationary head 37 is disposed at proximal end 32 and an opposing shell cover 38 is disposed at distal end 34. Head 37 defines a channel 39 forming an internal chamber which defines a tube-side header or plenum 40 which receives and discharges the tube-side fluid via inlet and outlet 60, 61. The head 37 may include a flange 41 which is bolted to a mating shell flange 42 in some embodiments as illustrated to provide ready access to the plenum and tube sheet 53 therein. The head 37 and cover 38 may have various types of configurations including without limitation elliptical, hemispherical, dished, flat, or other.

The heat exchanger 30 also comprises a tube sheet 53 disposed at stationary head 37 of the vessel. Tube sheet 53 has a substantially transverse orientation to longitudinal axis A-A that fluidly isolates the internal cavity 36 of the shell from the tube-side plenum 40. The plenum 40 extends longitudinally from the tube sheet 53 to the proximal end 32 at the head 37 while the shell-side internal cavity 36 extends longitudinally from the tube sheet to the distal end 34 of the shell 310 at the shell cover 38. In one embodiment, the tube sheet 53 may be interposed between the shell flange 42 and channel flange 41 forming an assembly which may be bolted together in some embodiments.

The heat exchanger 30 comprises a plurality of inlets and outlets that form passageways through the shell 33 so that shell-side and tube-side fluids 80, 81 can pass into or out of different constituent components and/or internal chambers of the vessel. Specifically, the heat exchanger 30 includes a tube-side fluid inlet 61, a tube-side fluid outlet 62, a shell-side fluid inlet 63 and a shell-side fluid outlet 64. In one embodiment, the tube-side fluid may be steam generator feedwater of a Rankine cycle power generation plant and the shell-side fluid may be steam. However, the invention is not so limited and of course other types of fluids may be used in various applications of the present invention.

In the non-limiting illustrated embodiment, the tube-side fluid inlet 60 may be located at the top of the stationary head 37 while the tube-side fluid outlet 61 may be located at the bottom. Other positions are possible and may be used. The tube-side fluid inlet 60 and outlet 61 may be arranged and oriented vertically. The centerlines C of the inlet 60 and outlet 61 in this orientation may be laterally offset by a distance D1 from the central vertical plane B-B defined by the heat exchanger (see, e.g. FIGS. 3 and 4). Central vertical plane B-B extends longitudinally from the proximal end 32 to the distal end 34 of the heat exchanger.

The shell-side fluid inlet 62 in the illustrated embodiment may be located on a top portion of the shell 33 at or near the distal end 34 of the shell while the shell-side fluid outlet 63 may be located on a bottom portion of the shell 310 at or near the distal end. Other positions are possible and may be used. The shell-side fluid inlet 62 and outlet 63 may be arranged and oriented vertically. The centerlines C of the inlet 61 and outlet 62 in this orientation may be aligned with the central vertical plane B-B defined by the heat exchanger.

Referring now to FIGS. 1-5, the internal components of the heat exchanger 30 will be described in greater detail. The tube bundle 50 is disposed in the internal cavity 36 of the heat exchanger shell 33 as best shown in FIG. 2. The tube bundle 50 comprises a plurality of longitudinally-extending double pass U-tubes 54 arranged in a densely packed configuration (only a few of the U-tubes are illustrated for clarity and to avoid clutter). The U-tubes 54 may have a length which extends for a majority of length of the internal cavity 36 and terminate inwards from the distal end 34 of the vessel being generally coextensive with the longitudinal axis A-A and longitudinal length of the shell 33. Of course, other shaped tubes, including straight tubes, may be used in the tube bundle 50. Finally, while the U-tubes 54 are exemplified as being double pass U-tubes, the invention is not so limited and each of the U-tubes 54 may include four, six, eight or more passes.

The U-tubes 54 have a general U-shape including an arcuately curved bight portion 55 that is generally located adjacent the distal end 34 of the heat exchanger 30 and two transversely spaced apart straight legs 56 that each are operably coupled to (or extend through) a plurality of openings formed in the tube sheet 53 so as to form passageways into and in fluid communication with the tube-side plenum 40. The free tube ends form a plurality of tube inlets and tube outlets of the tube bundle 50 and may be secured to the tube sheet 53 via any suitable method, including welding, machine or explosive expansion, etc. to ensure no leaking of fluids between the shell-side and tube-side.

Figure 3:
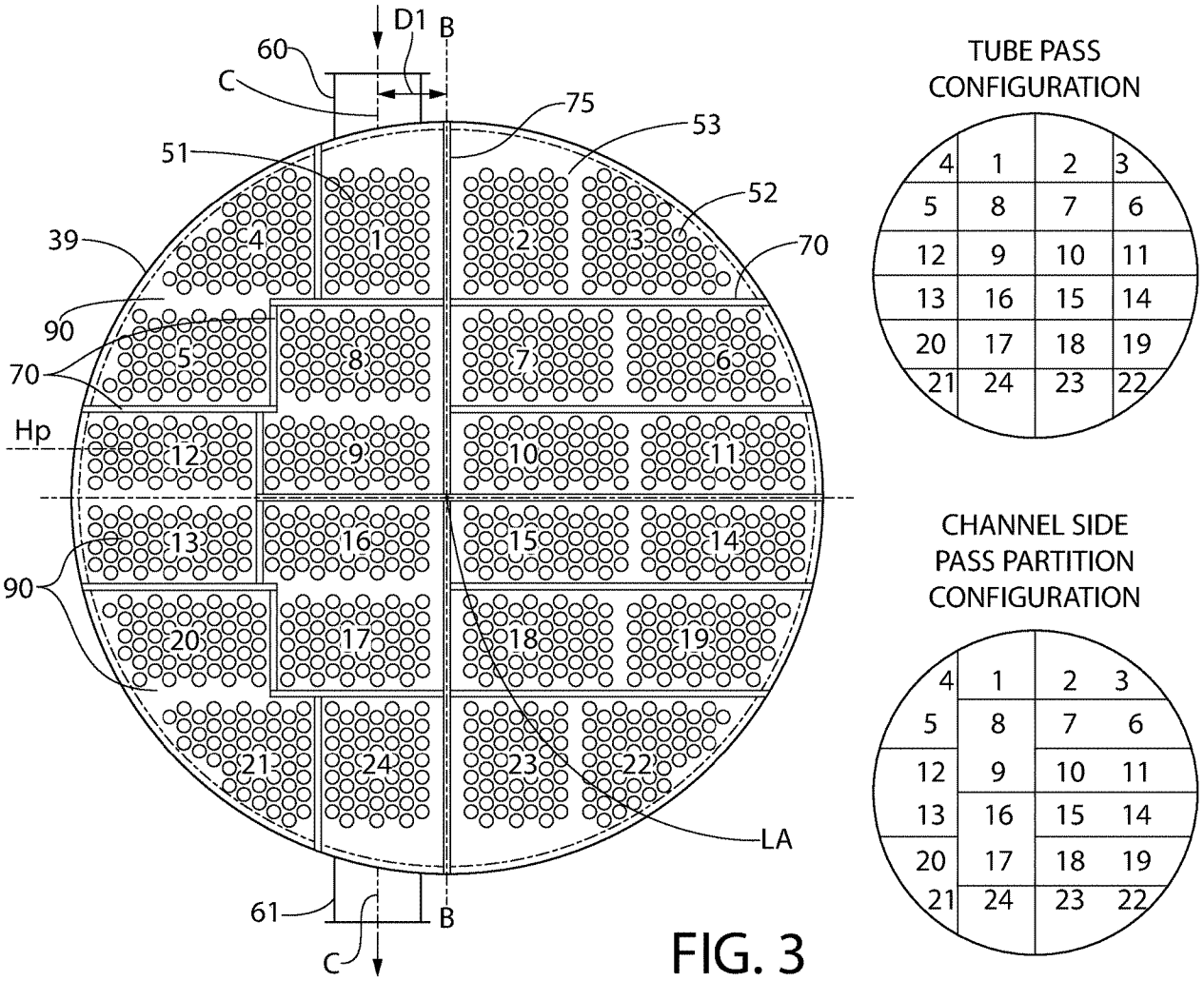
FIG. 3 is a schematic end view of the channel or tube-side fluid inlet header with cover removed to show an arrangement of pass partitions which form a plurality of tube-side flow compartments and passes.

In one embodiment, the tube bundle 50 may be arranged and configured so that the U-tubes 54 form an inner tube array 51 and an outer tube array 52 disposed outboard of the inner tube array. Each array comprises a plurality of U-tubes 54 formed into a cluster. The inner tubes 51 are therefore nested inside the outer tubes 52 in a densely packed arrangement for reasons which will become apparent. The heat exchanger 30 includes a plurality of pairs of inner and outer tube arrays 51, 52. Each pair is horizontally oriented and multiple pairs are arranged in vertically stacked spaced apart relationship on the tube sheet 53 as best shown in FIG. 3. Accordingly, the inner and outer tube arrays or clusters are each horizontally arranged in a horizontal plane Hp and separated horizontally and vertically by relatively small gaps. It bears noting that each U-tube 54 creates two passes. For example, passes 1-2 are formed by the inner tube array 51 and passes 3-4 are formed by the outer tube array 52 each within the first shell-side compartment or pass 1, and so forth. In one embodiment as illustrated, the U-tubes of the outer and inner tube bundle arrays 52, 51 are symmetrically arranged around a vertical central plane of the heat exchanger. It should be noted that the tube-side flow occurs in both counter-flow and co-flow patterns to the shell-side fluid within each horizontally oriented tube bundle in each shell-side fluid pass 1-6.

In one embodiment, a plurality of flow pass partitions 70 are disposed in the tube-side plenum 40 defined by channel 39 of the stationary head 37. The pass partitions 70 may be formed of metallic plates and define a plurality of tube-side fluid compartments 90 which are fluidly isolated from each other. The compartments 90 therefore help segregate the tube-side fluid flow in the plurality of tube-side passes. A vertical central pass partition 75 may be provided as shown best in FIG. 3 which in one embodiment divides the tube-side header or plenum 40 into equal halves on each side thereof. The central pass partition extends in the central vertical plane B-B from a top to a bottom of the tube-side plenum. Central pass partition 75 and vertical plane B-B of the heat exchanger intersect the longitudinal axis LA and extend perpendicularly thereto. Other pass partitions 70 on each lateral side thereof may be arranged orthogonally to the main vertical pass partition in a combination of vertical and horizontal orientations as shown.

In one embodiment, one half of the tube-side plenum 40 (e.g. right half in FIG. 3) may include a plurality of horizontal pass partitions 70 spaced vertically apart which each define a tube-side fluid compartment 90. These vertically stacked tube-side fluid compartments 90 include both tube inlets and tube outlets of the tube bundle 50. The tube-side fluid enters each of these vertically stacked fluid compartments from the tube outlets, flows horizontally through the compartments, and leaves the compartments through the tube inlets. The pass partitions 70 in the remaining other half of the tube-side plenum 40 (e.g. left half) may be arranged orthogonally in a combination of vertical and horizontal orientations to define a plurality of differently configured tube-side fluid compartments 90. Each of these compartments may include both tube inlets and outlets with exception of the compartments 90 in passes 1 and 24 which receive and discharge the tube-side fluid from the heat exchanger via tube-side fluid inlet 60 and outlet 61, respectively. These two fluid inlet and outlet fluid compartments 90 each only contain a tube inlet and tube outlet, respectively. Other arrangements of pass partitions and fluid compartments are possible.

Figure 4:
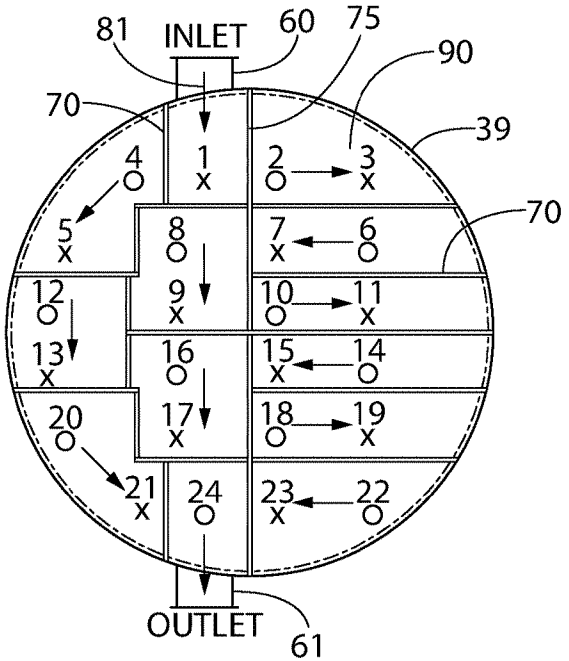
FIG. 4 is another view thereof annotated to show the flow path of tube-side fluid between the tube bundle portions.
Figure 6:
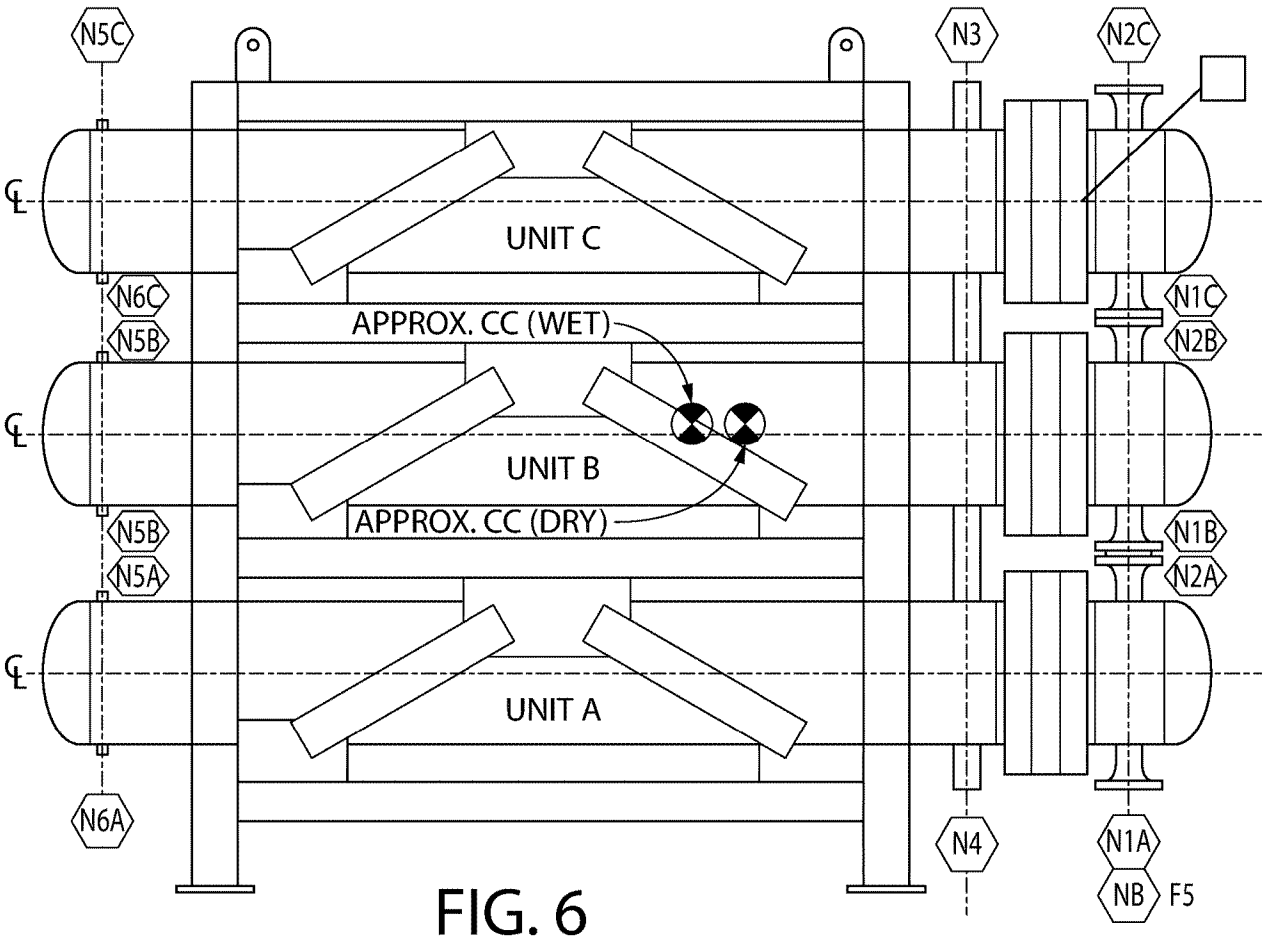
FIG. 6 (Prior Art)
FIG. 6 is a side view of a prior known arrangement of fluidly interconnected and stacked heat exchanger units.

Each pass partition 70 and vertical central pass partition 75 are sealably attached along one edge to the tube sheet 53 and along remaining edges to other pass partitions, the interior surface of channel 39, and/or the stationary head bonnet 57 or another internal structure or closure plate to form the fluidly isolated fluid compartments 90 depending on the particular location of the pass partitions in the channel. The pass partitions 70 generally comprise substantially flat metallic plates of a suitable material and configuration. One non-limiting arrangement and number of pass partitions 70 is shown in FIGS. 3-4 which is an end view of the tube sheet 53 looking towards the shell 33 from the stationary head 37 end of the heat exchanger. Preferably, more than 2 tube-side passes are provided. An even or odd number of passes may be provided. In the illustrated embodiment, 24 tube-side fluid passes are formed; however, fewer or more tube-side fluid passes may be used. The pass partitions 70 and vertical central partition 75 may be fluidly sealed to prevent or minimize leakage between the flow compartments 90 via any suitable method used in the art including welding, gaskets, seals, or combinations thereof. The seals between the partitions 70, 75 to the head bonnet 57 which may be removable to access the tubesheet may be via a non-welded type of mechanical seal (i.e. gaskets or seals).

Figure 5:
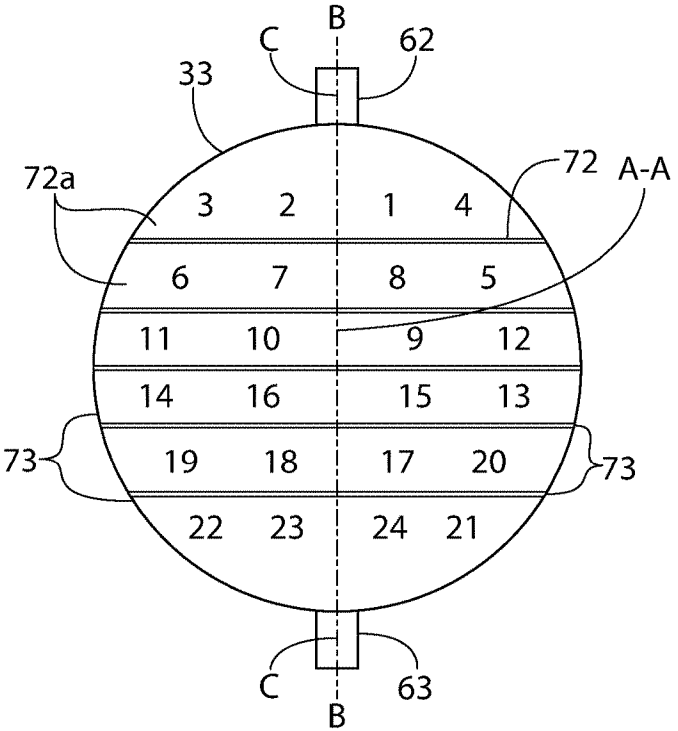
FIG. 5 is a transverse cross sectional side of the shell of the heat exchanger showing the arrangement of the longitudinal baffles and shell-side fluid passes of FIG. 1.

In one embodiment with reference to FIGS. 1 and 5, a plurality of shell-side passes 72*a* is similarly formed within shell 33. The shell-side fluid passes are formed by a plurality of vertically stacked and spaced apart longitudinal baffles 72 formed of metallic plates of suitable material. Baffles 72 may be oriented horizontally as shown; however, vertical or other angular orientations may be used depending in part on the location of the shell-side fluid inlet and outlet on the shell 33. Each baffle 72 extends parallel to longitudinal axis A-A for a majority of the length of the shell 33. The baffles are each sealed along their opposing longitudinal edges 73 to the shell 33 (see, e.g. FIG. 5). A set of first baffles 72 are each sealably attached such as via welding to shell cover 38 at their distal end adjacent to distal end 34 of the heat exchanger vessel, and at their proximal end adjacent to tube sheet 53 are spaced horizontal apart from the tube sheet to create a flow path to a vertically adjacent shell-side pass. Conversely, a remaining set of second baffles 72 are each interspersed between baffles in the first set. These second baffles 72 are sealably attached such as via welding at their proximal end to tube sheet 53, and at their distal end are spaced horizontal apart from the shell cover 38 to create a flow path to a vertically adjacent shell-side pass. Accordingly, each type of longitudinal baffle 72 is alternated within the vertical stack of baffles so that the ends of adjacent baffles are staggered horizontally with respect to each other. This directs the shell-side flow from the inlet 62 to the outlet 63 through the labyrinth of baffles 72 seen in FIG. 1 (see directional flow arrows), thereby creating multiple shell-side fluid passes. Preferably, more than 2 shell-side passes are provided. An even or odd number of passes may be provided. In the illustrated embodiment, 5 longitudinal baffles 72 may be provided to form 6 shell-side fluid passes within the internal cavity 36 of the vessel shell 33.

The non-limiting illustrated embodiment comprises 6 shell-side fluid passes and 24 tube-side fluid passes. The pass partitions 70 are arranged so that there are multiple tube-side passes in each of the shell-side passes. In the present arrangement, each shell-side pass shown contains 4 tube-side passes formed by one set each of inner and outer U-tubes arrays 51, 52. The tube arrays 51, 52 in each shell-side pass are oriented horizontally to create 6 vertically stacked layers of nested inner and outer tube arrays each comprising a plurality of U-tubes 54. FIG. 3 best illustrates the U-tube arrays and arrangement with respect to the pass partition 70 arrangement. The tube-side fluid passes are consecutively numbered from 1 to 24 in the order in which flow moves from the tube-side inlet 60 at top, through the tube bundle 50 within the shell cavity 36 on the shell-side, and outwards through the tube-side outlet 61 at bottom. Each pass 1-24 is associated with a cluster of tubes in each of the inner and outer tube arrays 51, 52. FIG. 5 shows each tube-side fluid pass 1-24 with respect to the longitudinal baffles 72 on the shell-side of the vessel.

Because the number of tube passes in each shell pass is a multiple of two in the non-limiting illustrated embodiment, the heat exchanger may thus be built with U-tubes which avoids having to provide a separate distal end return flow plenum for the tube-side fluid. While FIG. 2 illustrates a 6 shell pass, 24 tube pass heat exchanger, it is possible to have a larger or smaller cluster of shell-side and tube-side passes. The shell-side flow stream can also be arranged in a full flow (classical TEMA E shell), split flow (TEMA G), or divided flow (TEMA H shell) configurations in each shell compartment through select provision and arrangement of shell-side cross flow baffles (i.e. baffles in each shell pass arranged perpendicular to the longitudinal axis or length of the shell. Different shell-side pass flow arrangements can be used in different shell-side passes. For example, the flow arrangement in one shell pass may emulate TEMA E shell and in the another may be a TEMA G or a TEMA H shell. In other words, the shell flow configuration in each shell compartment may be different so as to meet the overall shell-side pressure loss limits and to maximize the "temperature correction factor." Furthermore, the types of cross baffles and their cut orientation can be selected for each shell compartment independent of the others.

The tube-side pass arrangement within each shell compartment can also be organized to optimize the layout. The 6 shell pass design illustrated above has 4 tube passes in each shell pass. However, maintaining an equal number of passes is not a conceptual design limitation. The number of tube passes in different shell compartments or passes can thus be unequal. Unequal number of tube passes is a useful design option if it helps elevate the heat exchanger's overall "temperature correction factor" or leads to a more fabricable design.

FIG. 4 shows the tube-side fluid 81 flow paths through the tube bundle 50 from the tube-side inlet 60 to outlet 61 through the tube-side fluid header or plenum 40. The directional flow arrows and other symbols identified in the legend indicate the direction of the tube-side fluid flow. As seen, with additional reference to FIG. 3, when the tube-side fluid is initially received in the top of plenum 40 from tube-side inlet 60, the fluid then completely traverses the entire lateral width of the heat exchanger from side-to-side on the shell-side within the upper-most shell-side fluid pass 1 (designated in FIG. 1). The tube-side fluid flows through tube-side passes 1-4 within the first shell-side pass 1 before then cascading downwards into the next group of tube-side passes 5-8. Assuming that the tube-side fluid is the cooler fluid to be heated by the hotter shell-side fluid, this advantageously exposes the initially cooler tube-side to four heating cycles in the uppermost shell-side pass 1 which contains the hottest shell-side fluid. Flow continues in a similar manner through each of the remaining lower and vertically stacked sets of tube-side fluid passes 5-24 within each of the remaining shell-side passes 2-6. Eventually, the now fully heated tube-side fluid leaves the U-tubes 54 in the last pass 24, re-enters the tube-side plenum 40 within the channel 39, and exits the heat exchanger through outlet 61 at bottom. It bears noting that the tube-side fluid completely traverses the length of the heat exchanger within the shell 33 while flowing through each of the U-tube passes 1-24, thereby defining 24 tube-side passes.

It bears noting for clarity that in FIG. 4, the flow exchange between some of the tube-side fluid passes (e.g. 2 to 3, 4 to 5, etc.) is shown to be accomplished within one of the tube-side compartments 90 within the plenum 40 of stationary head 37 (designated by the flow arrows). This occurs both when the tube-side fluid is exchanged between the inner tube array 51 and outer tube array 52 of the same horizontal row of tube arrays in each shell-side pass 1-6 (e.g. 2-3, 6 to 7, etc.), and also between an inner tube array 51 or outer tube array 52 of one shell pass to another inner tube array 51 or outer tube array 52 of a second shell pass (e.g. 4 to 5, 8 to 9, etc.). In other cases, the tube-side passes are formed by the outgoing leg of each U-tube from the proximal end 32 to the distal end 34 and ingoing leg of the tube in the opposite direction.

For each horizontal set or pair of inner tube array 51 and outer tube array 52 in each horizontal row or shell-side pass 1-6, tube-side fluid flows in opposing longitudinal axial directions within the tubes of the inner and outer tube arrays (in both co-current/co-flow and counter-flow to the shell-side fluid). Referring to FIGS. 2, 4, and 5 considering tube-side passes 1-4, for example, the tube-side fluid flows in tube-side pass 1 of the inner tube array 51 in a first direction from the head 37 towards the opposing shell cover 38 while the fluid flows in an opposite second direction from the shell cover 38 end back towards the head in tube-side pass 4 of the outer tube array 52. The same applies to tube-side passes 2 and 3 in this horizontal row. A vertical central plane B-B divides the shell 33 into a right and left half when viewed from the head 37 looking from the proximal end 32 towards the distal end 34 of the heat exchanger vessel (see FIG. 5). Accordingly, tube-side fluid flow inside the tubes of the inner tube array 51 in each of the right and left halves is flowing in an opposite direction from the tube-side fluid flow inside the tubes of the outer tube array 52. This holds true for the tube-side fluid flow throughout the remaining tube arrays in the illustrated embodiment.

On the shell-side, the shell-side fluid 80 enters the top of shell 33 from inlet 62, flows downwards through the array of longitudinal baffles 72 while traversing the length of the heat exchanger, and then exits at bottom through outlet 63. Each shell-side compartment or pass 1-6 heats four passes of tube-side fluid.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A heat exchanger comprising:

a pressure vessel comprising a shell cavity, a shell inlet configured to introduce a shell-side fluid into the shell cavity, and a shell outlet configured to allow the shell side fluid to escape the shell cavity, the pressure vessel extending along a longitudinal axis;

a shell-side fluid flow control system disposed within the shell cavity and configured to flow the shell-side fluid through the shell cavity, from the shell inlet to the shell outlet, the shell-side fluid flowing through a plurality of vertically stacked shell-side fluid passes;

a tube bundle disposed within the shell cavity, the tube bundle comprising a plurality of tube inlets and a plurality of tube outlets, the tube bundle configured to carry flow of a tube-side fluid from the tube inlets to the tube outlets such that the tube-side fluid performs a first set of plural horizontally arranged tube-side fluid passes in a first one of the vertically stacked shell-side fluid passes and a second set of plural horizontally arranged tube-side fluid passes in a second one of the vertically stacked shell-side fluid passes, wherein the tube inlets and the tube outlets are fluidly coupled to a tube-side plenum at a proximate end of the pressure vessel via a tube sheet fluidly isolating the tube-side plenum from the shell cavity;

a vertical central pass partition extending in a vertical central plane from a top to a bottom of the tube-side plenum and dividing the tube-side plenum into a first half and a second half, wherein the first half of the tube-side plenum includes a plurality of horizontal pass partitions spaced vertically apart which define a set of first tube-side fluid compartments;

the second half of the tube-side plenum includes a plurality of pass partitions that are arranged orthogonally in a combination of vertical and horizontal orientations to define a set of second tube-side fluid compartments; and wherein the tube-side fluid completes all horizontally arranged tube-side fluid passes in each shell-side fluid pass before cascading to a next shell-side fluid pass.

2. The heat exchanger according to claim 1 wherein the tube bundle comprises a plurality of U-tubes arranged to form an outer tube bundle array and an inner tube bundle array nested inside the outer tube bundle array that collectively form the horizontally arranged tube-side fluid passes in the first and second ones of the vertically stacked shell-side fluid passes.

3. The heat exchanger according to claim 1, wherein each first tube-side fluid compartment includes both tube inlets and tube outlets of the tube bundle, the tube-side fluid entering each tube-side fluid compartment from the tube outlets, flowing horizontally, and leaving the tube-side fluid compartments through the tube inlets.

4. The heat exchanger according to claim 1, wherein one of the second tube-side fluid compartments includes tube bundle inlets which are in fluid communication with the tube-side inlet, and one of the second tube-side fluid compartments includes tube bundle outlets which are in fluid communication with the tube-side outlet.

5. The heat exchanger according to claim 1, wherein the tube-side fluid in the first set of plural horizontally arranged tube-side fluid passes in the first one of the vertically stacked shell-side fluid passes progresses from innermost tubes of the tube bundle to outermost tubes of the tube bundle, and the tube-side fluid in the second set of plural horizontally arranged tube-side fluid passes in the second one of the vertically stacked shell-side fluid passes progresses from outermost tubes of the tube bundle to innermost tubes of the tube bundle, the innermost tubes of the tube bundle being positioned relatively closer to a central vertical plane that extends longitudinally from a proximal end to a distal end of the heat exchanger than the outermost tubes of the tube bundle.

6. The heat exchanger according to claim 5, further comprising horizontally arranged tube-side fluid passes in a third one of the vertically stacked shell-side fluid passes adjacent the second one of the vertically stacked shell-side fluid passes, wherein the tube-side fluid in the horizontally arranged tube-side fluid passes in the third one of the vertically stacked shell-side fluid passes progresses from innermost tubes of the tube bundle to outermost tubes of the tube bundle.

7. The heat exchanger according to claim 1, wherein the tube-side flow occurs in both counter-flow and co-flow patterns in each shell-side fluid pass.

8. A tubular heat exchanger comprising:

a shell comprising a shell cavity, a shell inlet to introduce a shell-side fluid into the shell cavity, and a shell outlet to exhaust the shell-side fluid from the shell cavity, the shell extending along a longitudinal axis and having a length;

the shell cavity comprising a plurality of longitudinal baffles dividing the shell cavity into multiple vertically stacked shell-side flow passes, wherein the shell-side fluid traverses the length of the shell cavity more than twice between the shell inlet and the shell outlet;

a stationary head attached to the shell and comprising an internal tube-side plenum fluidly isolated from the shell cavity, a tube-side inlet to introduce a tube-side fluid into the tube-side plenum, and a tube-side outlet to discharge the tube-side fluid from the tube-side plenum;

a plurality of vertically stacked horizontal rows of tube bundle sets inside the shell and in fluid communication with the tube-side plenum, each tube bundle set comprising an outer tube bundle array and an inner tube bundle array nested inside the outer tube bundle array;

each shell-side flow pass including a tube bundle set which forms a plurality of tube-side flow passes in each shell-side flow pass;

wherein the tube-side fluid flows in a vertically cascading pattern from an uppermost tube bundle set fluidly coupled to the tube-side inlet, through a plurality of intermediate tube bundle sets, and to a lowermost tube bundle set fluidly coupled to the tube-side outlet;

wherein the tube-side fluid flows horizontally in each tube bundle set before cascading to a next tube bundle set; and wherein the tube-side fluid in the uppermost tube bundle set flows from the tube-side inlet to the inner tube bundle array and then to the outer tube bundle array, the tube-side fluid in the intermediate tube bundle set adjacent the uppermost tube bundle set flows from the outer tube bundle array to the inner tube bundle array, and the tube-side fluid in the lowermost tube bundle set flows from the outer tube bundle array to the inner tube bundle array and then to the tube-side outlet.

9. The heat exchanger according to claim 8, wherein the tube-side flow occurs in both counter-flow and co-flow patterns in each shell-side flow pass.

10. The heat exchanger according to claim 8, wherein the outer and inner tube bundle arrays each include a plurality of U-tubes.

11. The heat exchanger according to claim 10, wherein the U-tubes of the outer and inner tube bundle arrays are symmetrically arranged around a vertical central plane of the heat exchanger.

12. A method for operating a tubular heat exchanger, the method comprising:

providing a heat exchanger including a shell defining a plurality of vertically stacked shell-side fluid passes, a tube-side plenum fluidly isolated from the shell-side and comprising a plurality of tube-side fluid passes, and a plurality of vertically stacked horizontal rows of tube bundle sets inside the shell and in fluid communication with the tube-side plenum;

receiving a tube-side fluid in a first one of the tube-side fluid passes;

the tube-side fluid flowing horizontal through a first set of horizontally arranged tube-side fluid passes in a first one of the tube bundle sets in a first one of the vertically stacked shell-side fluid passes;

the tube-side fluid cascading vertically to an adjacent second one of the vertically stacked shell-side fluid passes;

the tube-side fluid flowing horizontally through a second set of horizontally arranged tube-side fluid passes in a second one of the tube bundle sets in the second one of the vertically stacked shell-side fluid passes;

the tube-side fluid cascading vertically to an adjacent third one of the vertically stacked shell-side fluid passes; and the tube-side fluid flowing horizontally through a third set of horizontally arranged tube-side fluid passes in a third one of the tube bundle sets in the third one of the vertically stacked shell-side fluid passes; and wherein the tube-side fluid progresses from an inner portion of the first one of the tube bundle sets to an outer portion in flowing horizontally through the first set of horizontally arranged tube-side fluid passes, wherein the tube-side fluid progresses from an outer portion of the second one of the tube bundle sets to an inner portion in flowing horizontally through the second set of horizontally arranged tube-side fluid passes, and wherein the tube-side fluid progresses from an inner portion of the third one of the tube bundle sets to an outer portion in flowing horizontally through the third set of horizontally arranged tube-side fluid passes.

* * * * *